US006454577B1

(12) United States Patent
Yi

(10) Patent No.: US 6,454,577 B1
(45) Date of Patent: Sep. 24, 2002

(54) ELECTRICAL CONNECTOR HAVING DEVICE FOR LATCHING AND GROUNDING

(75) Inventor: Chong H. Yi, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/029,780

(22) Filed: Oct. 19, 2001

(51) Int. Cl.[7] ..... H01R 13/648

(52) U.S. Cl. ..... 439/108; 439/610; 439/357; 439/378

(58) Field of Search ..... 439/92, 95, 101, 439/108, 98, 607, 610, 356, 357, 358, 378

(56) References Cited

U.S. PATENT DOCUMENTS 4,838,808 A * 6/1989 Fujiifa ..... 439/357
6,186,819 B1 * 2/2001 Holub ..... 439/358
6,257,914 B1 * 7/2001 Comevii et al. ..... 439/357
6,290,530 B1 * 9/2001 Chong ..... 439/357
6,328,601 B1 * 12/2001 Yip et al. ..... 439/610

* cited by examiner

*Primary Examiner*—Hien Vu
(74) *Attorney, Agent, or Firm*—WeiTe Chung

(57) ABSTRACT

An electrical connector (1) comprises a base (11) defining a receiving block (11*b*) adjacent to a front end thereof and a cover (12) is assembled to the base. A latch (20) is pivotably assembled to the receiving block. A grounding tab (30) is attached to the cover for electrically establishing a grounding path to a receptacle connector (4) in which the electrical connector is mated. Interengaging device is formed between the cover and the base and includes a pair of recesses (11*c*) defined in the base, and a pair of anchoring legs (12*c*) snugly received in the recesses.

5 Claims, 8 Drawing Sheets

ELECTRICAL CONNECTOR HAVING DEVICE FOR LATCHING AND GROUNDING

CROSS-REFERENCE TO RELATED APPLICATIONS

This application is related to a co-pending U.S. patent application Ser. No. 09/826,995 filed on Apr. 4, 2001, titled "ELECTRICAL CONNECTOR" and assigned to the same assignee as the present application.

BACKGROUND OF THE INVENTION

1. Field of the Invention

The present invention is generally related to an electrical connector, and more particularly to an electrical connector having a latch pivotally assembled thereto. The electrical connector further comprises a grounding tab for establishing a grounding path with a receptacle in which the electrical connector is mated.

2. Description of the Related Art

Latches are widely used for plug and receptacle connectors to ensure reliable electrical connection therebetween. An early use of latch is shown in U.S. Pat. Nos. 4,221,458 and 4,379,609. These patents describe modular jacks each having a latch, wherein the latch has an impending end which is apt to be damaged when improperly drawn outwardly. Improved designs are shown in Taiwan Patent Application Nos. 83201276 and 81213465. These patents describe modular jacks each having a shield to receive an impending end of a latch thereof. The latch is almost free from being damaged for the impending end cannot be drawn outwardly in use.

However, users must press the impending end downwardly when pulling the modular jack out of a receptacle. Since there is not enough space for placing a finger between the modular jack and the receptacle in order to press the impending end of the latch and to pull the modular jack out, it is not convenient in practical use.

In addition, in some circumstances, such as when the plug is made by die casting, a grounding path is required between the plug and the receptacle. One of the approaches is to provide a metal latch which can perform functions of engagement as well as grounding. However, it is preferable to perform the engagement and grounding functions between the plug and receptacle separately.

Hence , an improved electrical connector is required to overcome the disadvantages of the related art.

BRIEF SUMMARY OF THE INVENTION

Therefore, one object of the present invention is to provide an electrical connector having separately formed plastic latch and grounding tab to provide a reliable engagement as well as grounding.

Another object of the present invention is to provide an electrical connector assembly comprising a plug connector and a receptacle connector, wherein the plug connector has a plastic latch and a grounding tab separately formed thereon to provide a reliable electrical connection as well as grounding, whereby the plug connector is easy to be pulled out from the receptacle.

To achieve the above-mentioned objects, an electrical connector in accordance with the present invention comprises a base defining a receiving block adjacent to a front end thereof and a cover is assembled to the base. A latch is pivotally assembled to the receiving block. A grounding tab is attached to the cover for electrically establishing a grounding path to a receptacle connector in which the electrical connector is mated. Interengaging device formed between the cover and the base and includes a pair of recesses defined in the base, and a pair of anchoring legs snugly received in the recesses.

Other objects, advantages and novel features of the invention will become more apparent from the following detailed description of the present embodiment when taken in conjunction with the accompanying drawings.

DETAILED DESCRIPTION OF THE INVENTION

Figure 1:
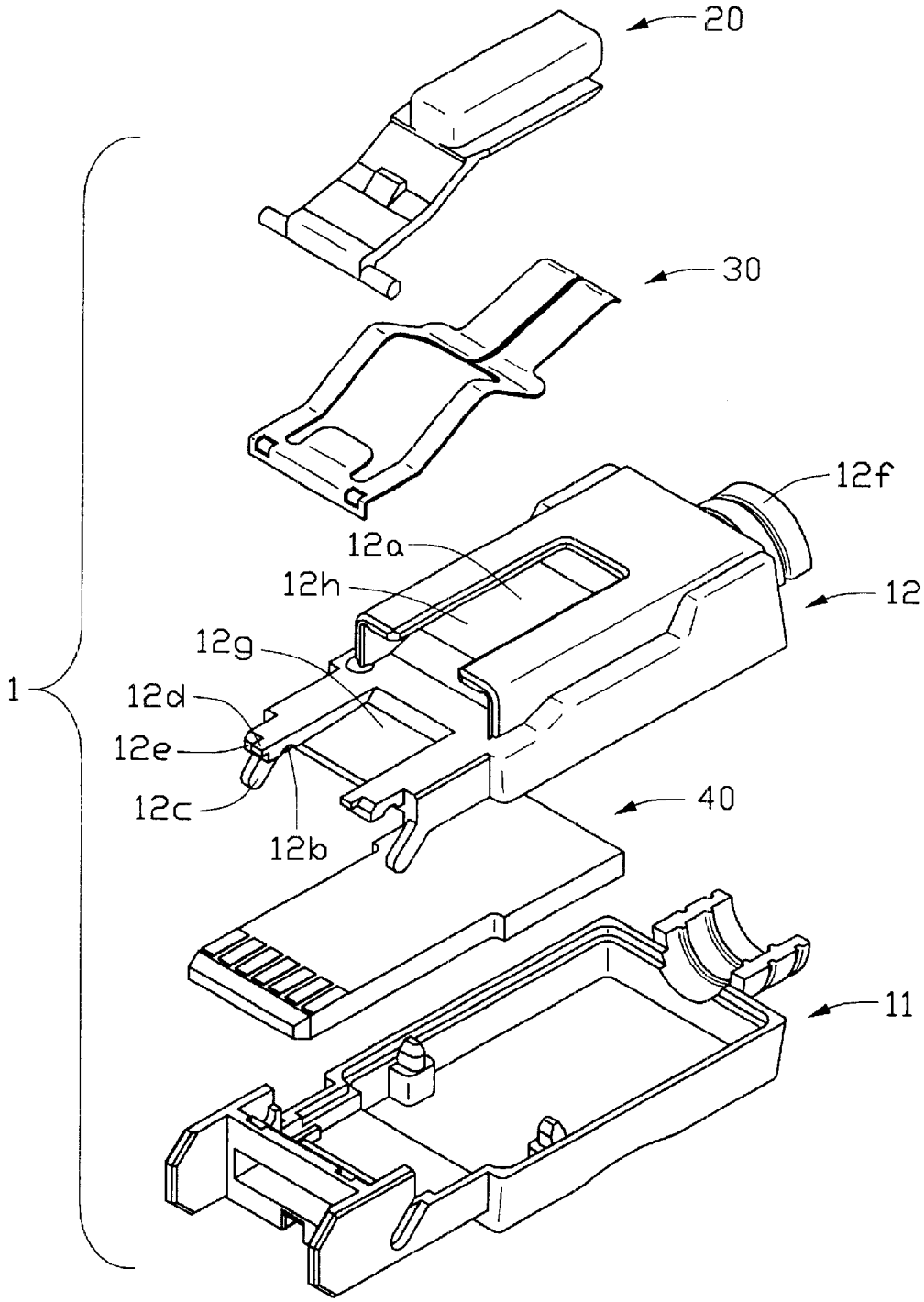
FIG. 1 is an exploded, perspective view of an electrical connector in accordance with the present invention.

Referring to FIG. 1, an electrical connector 1 in accordance with the present invention includes a housing comprising a base 11, a cover 12 for being assembled to the base 11, a plastic latch 20, a grounding tab 30 and an electrical component 40 received in the base 11.

Figure 2:
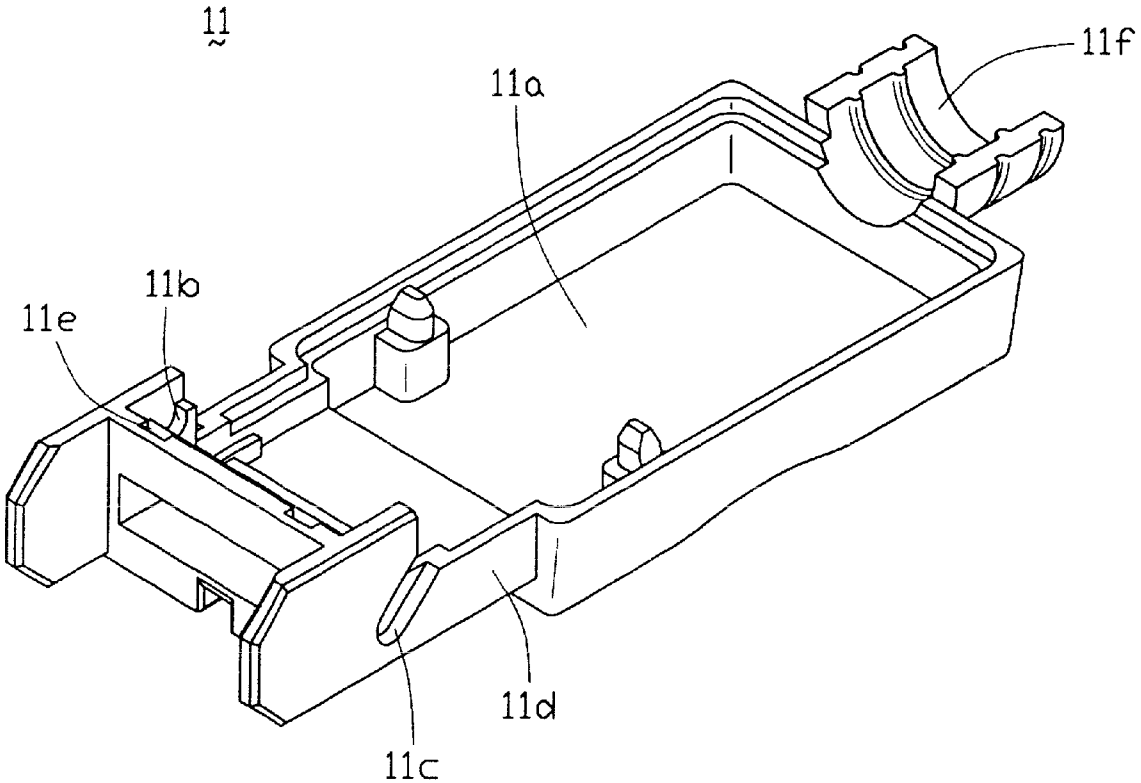
FIG. 2 is a perspective view of a base of the electrical connector in accordance with the present invention.

As is shown in FIG. 2, the base 11 comprises a receiving space 11*a* in a middle thereof for receiving the electrical component 40, a pair of receiving blocks 11*b* (only one visible) adjacent to a front end thereof, and a tail portion 11*f* extending rearward adjacent to a rear end thereof. A pair of recesses 11*c* is defined in sidewalls 11*d* of the base 11 adjacent to the receiving blocks 11*b*. A pair of receiving holes 11*e* is defined in front of the receiving blocks 11*b*.

The cover 12 is mateable with the base 11 and comprises a cut-out 11*a* at the top end thereof, a concave 11*b* mateable with the receiving block 11*b* of the base 11 adjacent to a front end thereof, a pair of anchoring legs 11*c* corresponding to the recesses 11*c* of the base 11, a pair of front faces 12*e* at the front end thereof, a pair of protrusions 12*d* adjacent to the front faces 12*e*, and a tail portion 12*f* at a rear end thereof mateable with the tail portion 11*f* of the base 11. The cover 12 further defines a flat 12*h* as a bottom of the cutout 11*a* and a depression 12*g* in communication with the cutout 12*a*.

Figure 3:
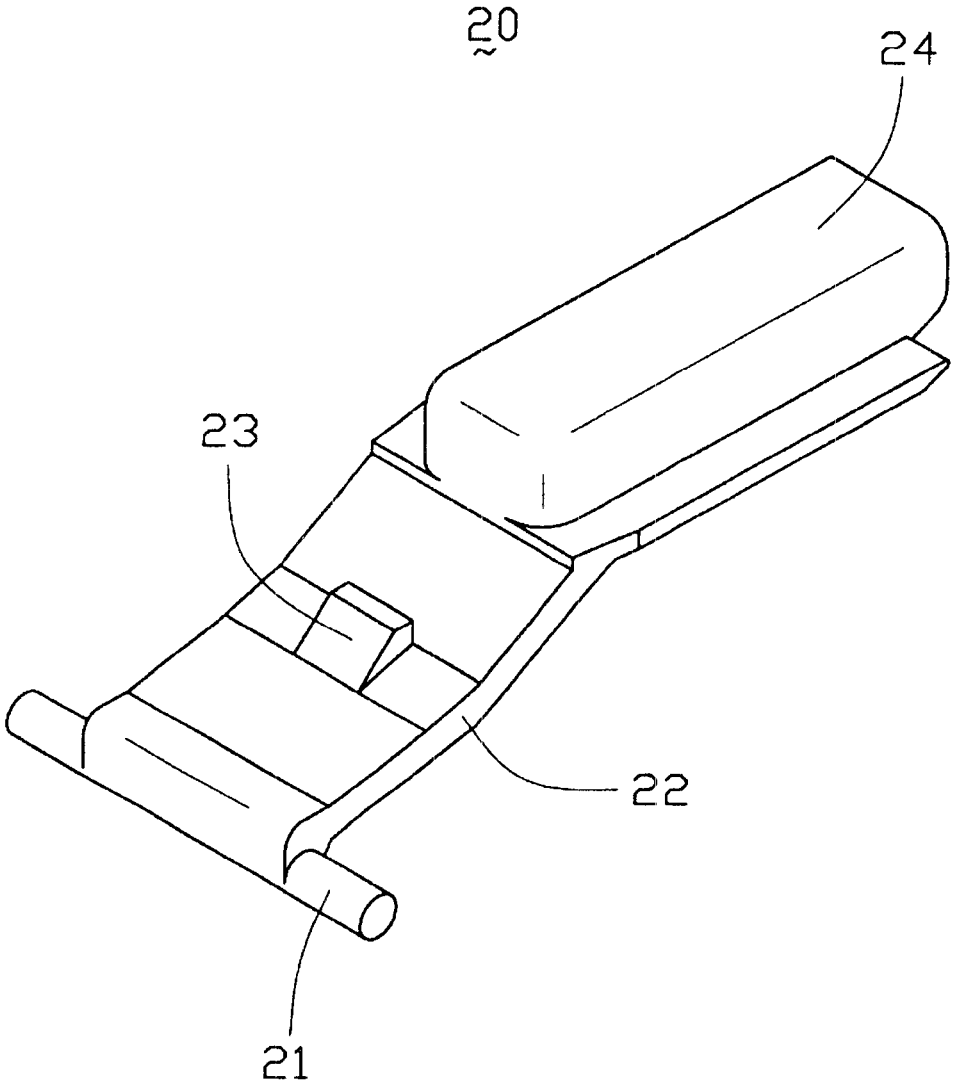
FIG. 3 is a perspective view of a latch of the electrical connector in accordance with the present invention.

Referring to FIG. 3, the latch 20 comprises an anchoring shaft 21 at a front end thereof and rotationally received in the receiving blocks 11*b* of the base 11, a plate portion 22 connected with the anchoring shaft 21, an engaging portion 23 projecting from the plate portion 22 in the middle thereof for engaging with a window 41 defined in a receptacle connector 4 (FIG. 8), and a press portion 24 projecting on the plate portion 22 in the rear end thereof.

Figure 4:
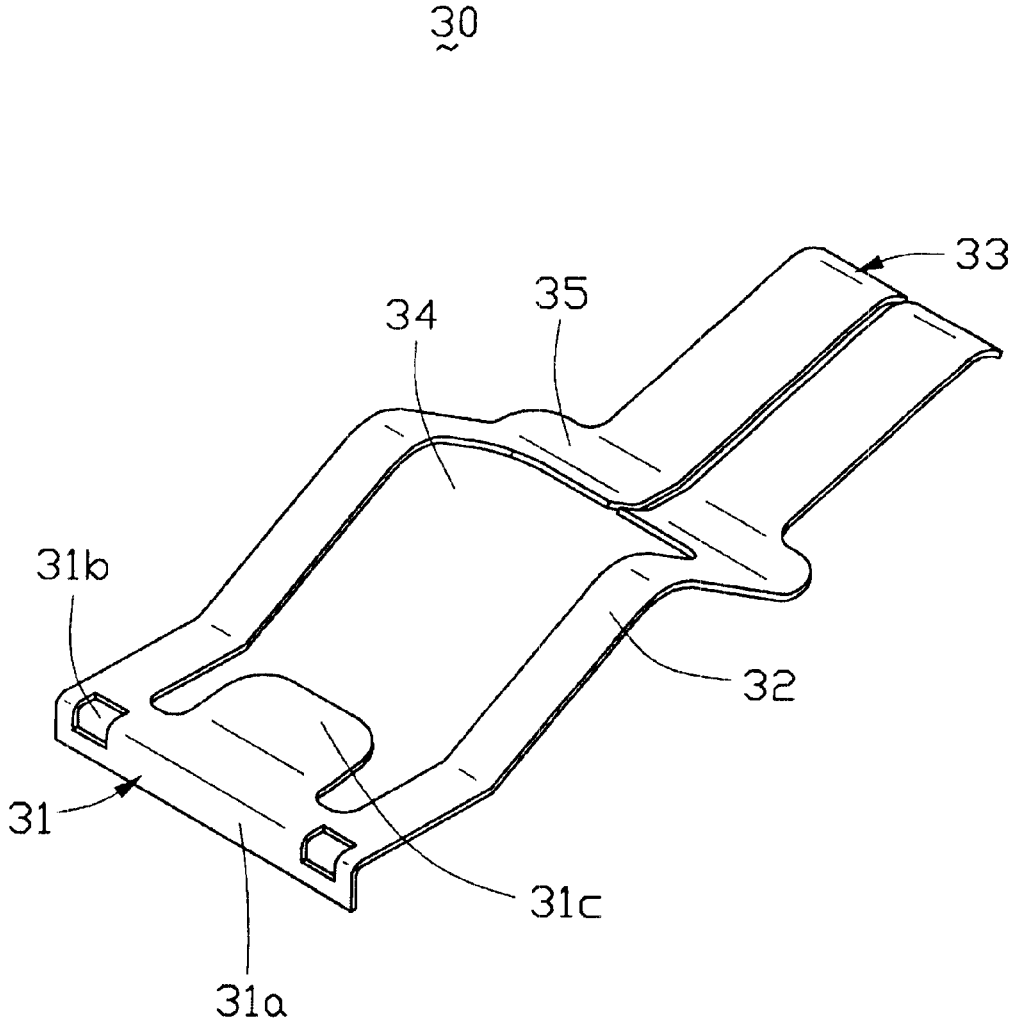
FIG. 4 is a perspective view of a grounding tab of the electrical connector in accordance with the present invention.

Referring to FIG. 4, the grounding tab 30 comprises a front end 31, a bent portion 35, a rear end 33 extending aslant impendingly from the bent portion 35, and a pair of spring arms 32 connected with the front end 31 and the bent portion 35. The front end 31 defines a front wall 3 la bent downward, a pair of holes 31*b* in opposite sides thereof and a pad 31*c* extending rearward. The two spring arms 32 are curved and define an opening 34 therebetween.

Figure 5:
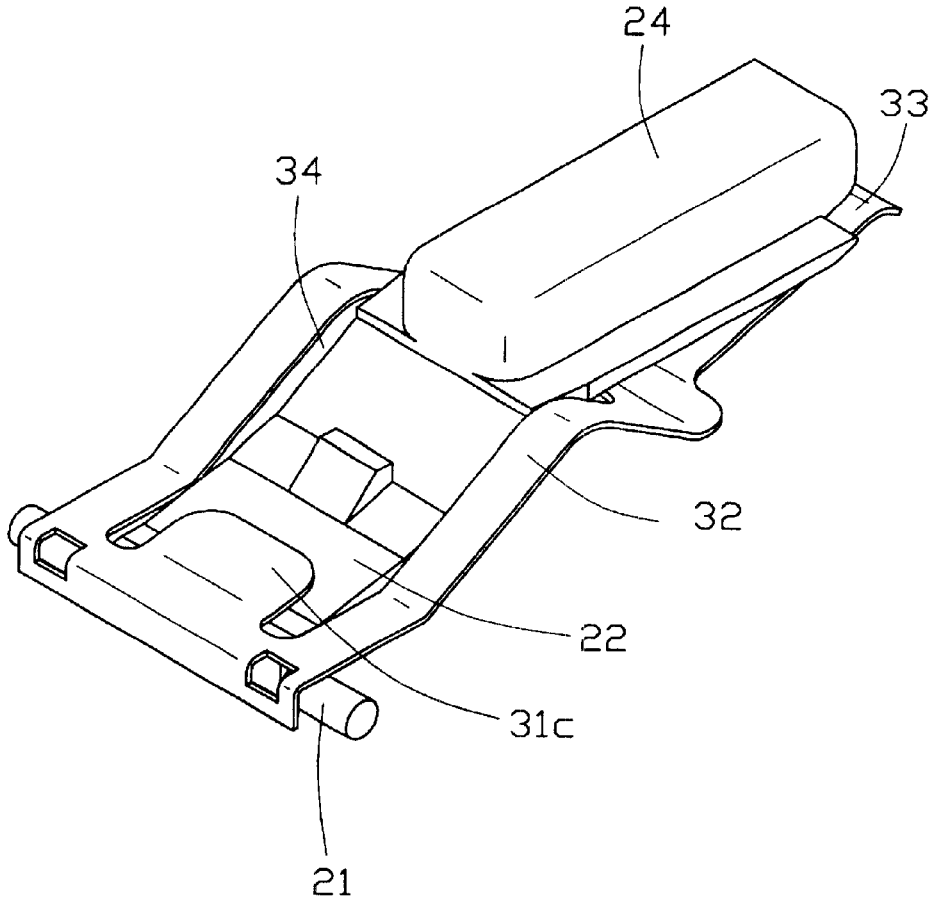
FIG. 5 is a perspective view showing the latch in FIG. 3 assembled to the grounding tab in FIG. 4.

Referring to FIG. 5, the press portion 24 of the latch 20 is inserted through the opening 34 of the grounding tab 30 and presses on the rear end 33 of the grounding tab 30. The plate portion 22 of the latch 20 is abutted to the pad 31*c* of the grounding tab 30.

Figure 6:
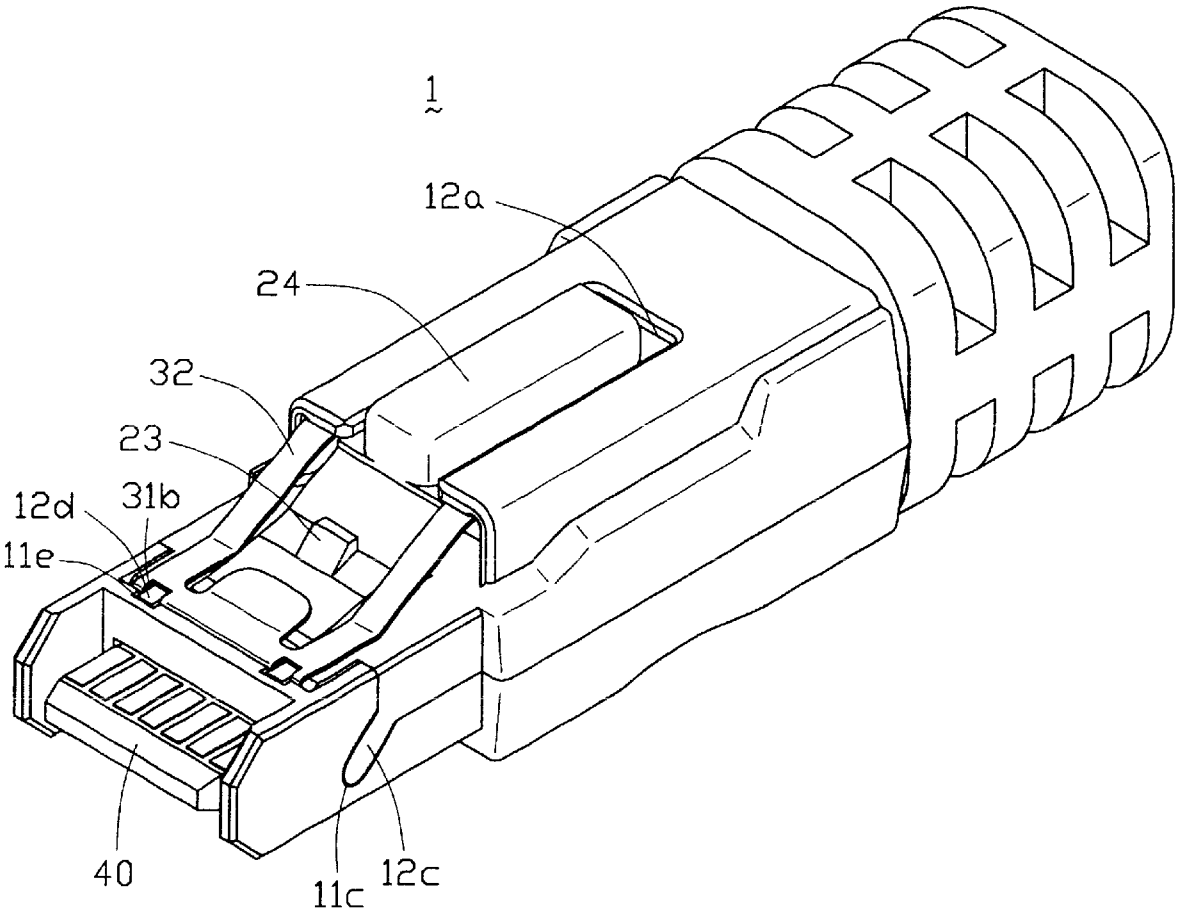
FIG. 6 is an assembled, perspective view of the electrical connector in accordance with the present invention.
Figure 7:
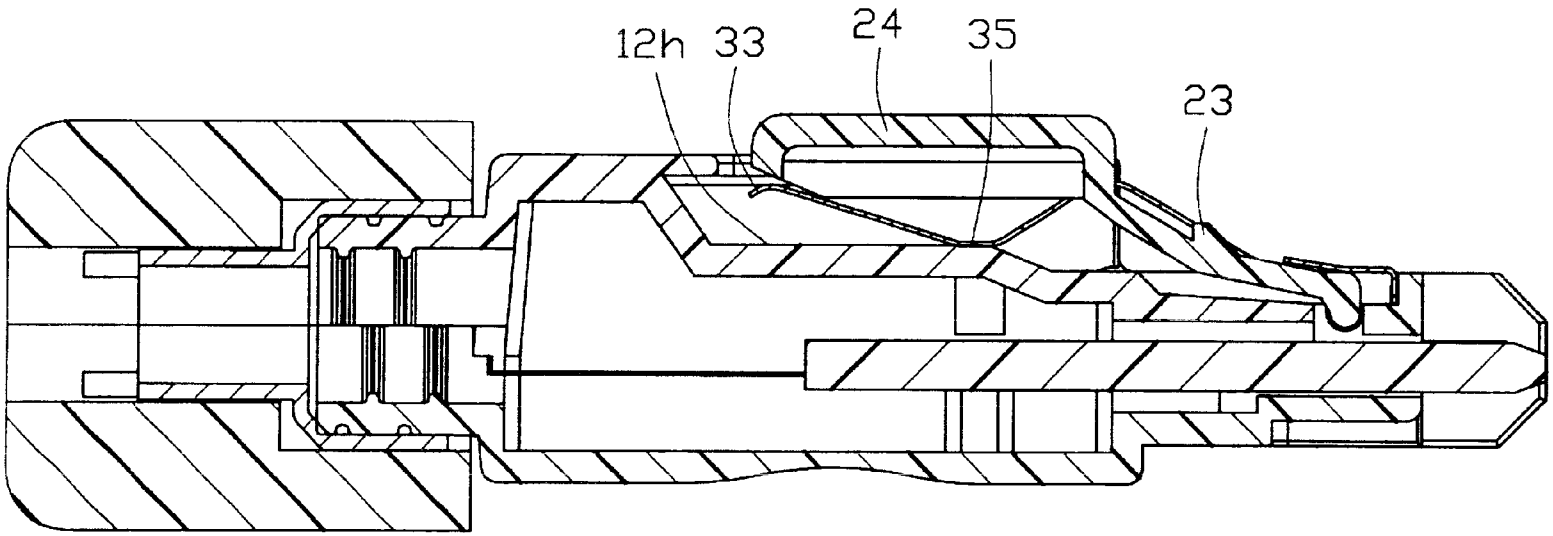
FIG. 7 is a sectional view of FIG. 6.
Figure 8:
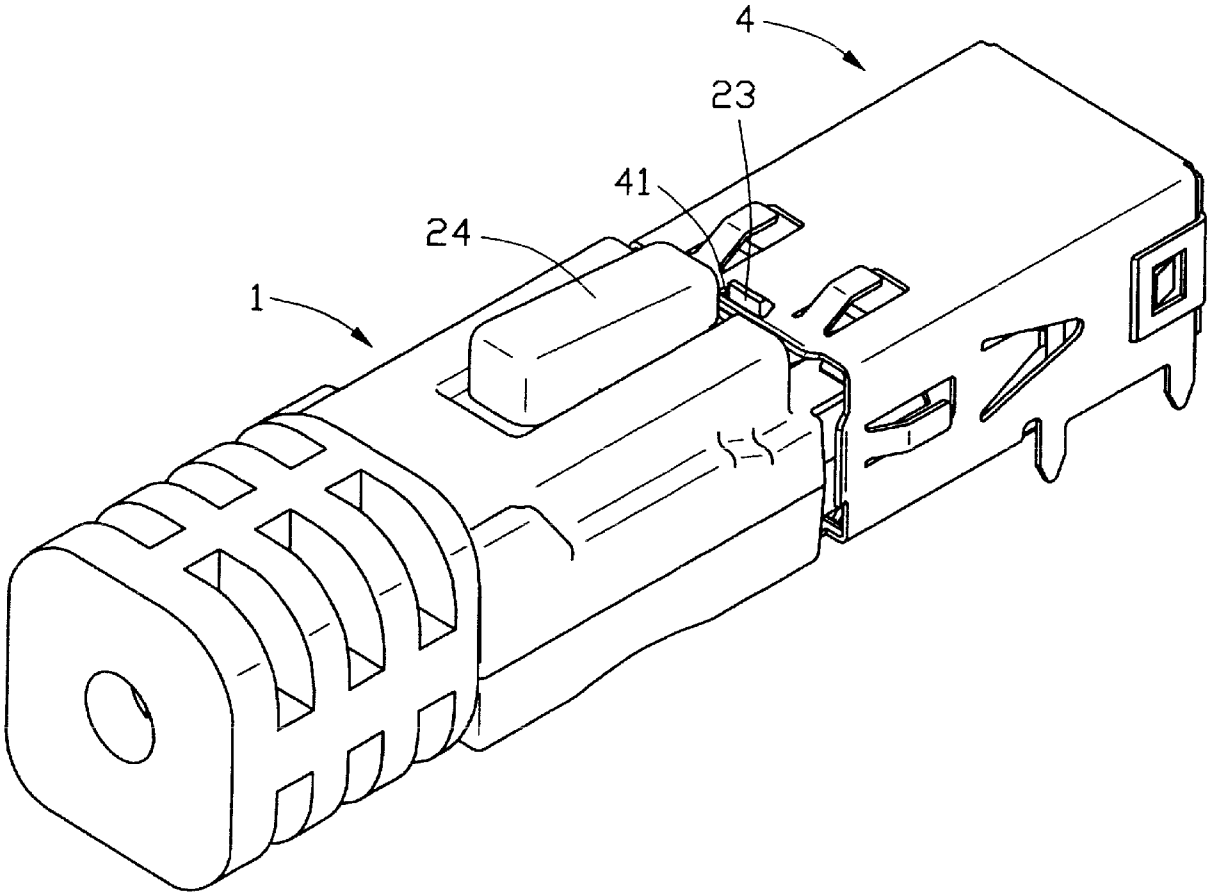
FIG. 8 is a perspective view showing the electrical connector of FIG. 6 being inserted in a mating connector.

Referring to FIGS. 6 to 8, after the cover 12 is assembled to the base 11, the shaft 21 of the latch 20 is put into the receiving blocks 11*b* and the concaves 11*b* and rotationally arranged between the cover 12 and the base 11. In addition, the latch 20 projects upward above the cutout 11*a* of the cover 12. The front wall 31*a* of the grounding tab 30 is sandwiched by the front faces 12*e* of the cover 12 and the protrusion 12*d* is also extending through the holes 31*b* of the grounding tab 30 and received in the receiving hole 11*e* of the base 11. As the bent portion 35 is seated on the flat 12*h* of the cover 12 and the rear end 33 is abutted with the latch 20, the latch 20 is pushed upward such that the engaging portion 23 is provided with locking force to engage with a receptacle connector 4 shown in FIG. 8. Once the press portion 24 is pressed downward, the engaging portion 23 is taken out of the window 41 and the electrical connector 1 can be removed from the receptacle connector 4. The spring arms 32 and the rear end 33 can bounce back and push the press portion 24 to its original position through the spring function provided by the grounding tab 30.

In order to facilitate a robust engagement between the base 11 and the cover 12, the recesses 11*c* is defined obliquely in the sidewall 11*d* of the base 11, while the cover 12 is provided with the anchoring legs 11*c* corresponding to the recesses 11*c*. The obliquely arranged recesses 11*c* and the anchoring legs 11*c* will make the assembly of the base 11 and the cover 12 more easy. After the base 11 and the cover 12 are assembled, a ferrule (not shown) can be attached to the tail portions 11*f*, 12*f* such that the base 11 and the cover 12 are securely fastened.

When the electrical connector 1 made according to the present invention is to be coupled to the receptacle connector 4 in FIG. 8, the user can easily insert the connector 1 into the receptacle connector 4 such that the engaging portion 23 of the latch 20 engages with a window 41 formed on the receptacle connector 4. Meanwhile, the spring arms 32 are also electrically connecting with inner upper wall of the receptacle connector 4 such that an electrical grounding path is established between the electrical connector 1 and the receptacle connector 4. This will further lower the EMI.

Upon the removal of the electrical connector 1 from the receptacle connector 4, the user can easily press down the press portion 24 of the latch 20 to disengage the connection between the engaging portion 23 and the window 41. Accordingly, the electrical connector 1 can be easily pulled out from the receptacle connector 4.

Since the latch 20 and the grounding tab 30 function differently, the structures of the latch 20 and the grounding tab 30 can be easily controlled to facilitate their intended function without influencing each other. As shown in FIG. 5, the spring arms 32 are higher than the engaging portion 23. As a result, the spring arms 32 will effectively engage with upper wall of the receptacle to establish a reliable grounding path. As long as the grounding tab 30 moves into the receptacle connector 4, the grounding path between the electrical connector 1 and the receptacle connector 4 is established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector sub-assembly, comprising:

a base;

an electrical component;

a cover assembled to the base and comprising a cutout at a top thereof and a flat portion at a bottom of the cutout;

a plastic latch comprising a shaft pivotally assembled to the base, an engaging portion for latching to a mating connector, and a press portion assembled through the cutout; and a metal grounding tab comprising a front end retained between the base and the cover, a rear end between the press portion and the flat portion, and a pair of spring arms connected between the front end and the rear end and disposed outside of the cover;

wherein the press portion of the latch is moveable through the cutout of the cover to disengage the engaging portion from the mating connector against a spring force exerted by the rear end upon the press portions wherein the grounding tab comprises an opening and the press portion of the latch is inserted through the opening; wherein the front end defines a front wall bent downward, a pad extending rearward and a pair of holes on opposite sides of the pad; wherein the base defines a receiving space for receiving the electrical component and a pair of receiving blocks for receiving the shaft of the latch.

2. The electrical connector sub-assembly as recited in claim 1, wherein the grounding tab comprises a bent portion defined between the spring arm and the rear end for abutting on the flat portion of the cover.

3. The electrical connector sub-assembly as recited in claim 2, wherein the grounding tab defines a pair of bent portions respectively connecting with the two spring arms and a pair of rear ends respectively extending from the two bent portions.

4. The electrical connector sub-assembly as recited in claim 1, wherein said base defines a pair of recesses adjacent to the receiving blocks and the cover includes a concave mateable with the receiving block of the base and adjacent to a front end thereof, a pair of anchoring legs corresponding to the recesses of the base.

5. The electrical connector sub-assembly as recited in claim 4, wherein said cover includes a pair of front faces at the front end thereof, a pair of protrusions a adjacent to the front faces, and a tail portion mateable with the tail portion of the base and extending rearward.

* * * * *